United States Patent [19]

Tzabanakis

[11] Patent Number: 4,524,792

[45] Date of Patent: Jun. 25, 1985

[54] TENT BRACKET

[75] Inventor: George Tzabanakis, Montreal, Canada

[73] Assignee: Les Ateliers Mecaniques Alexandre, Inc., Montreal, Canada

[21] Appl. No.: 512,711

[22] Filed: Jul. 11, 1983

[51] Int. Cl.[3] ..... A45F 1/06

[52] U.S. Cl. ..... 135/90; 135/109; 135/900; 248/210; 248/218.4

[58] Field of Search ..... 135/109, 110, 111, 119, 135/120, 90, 96, 98, 101, 105, 106, 21, 27, 901, 905, DIG. 9, 904, 900; 248/210, 211, 238, 218.4, 99, 100; 403/217

[56] References Cited

U.S. PATENT DOCUMENTS

| | | | |
|---|---|---|---|
| 477,235 | 6/1892 | Timmerman | 248/99 |
| 549,037 | 10/1895 | Wade | 248/238 |
| 1,281,691 | 10/1918 | Stockwell | 135/109 |
| 1,401,244 | 12/1921 | Eastlund | 135/109 X |
| 2,439,185 | 4/1948 | Patt | 248/210 X |
| 3,116,808 | 1/1964 | Riley | 135/900 X |
| 3,407,825 | 10/1968 | Doyle | 135/900 X |
| 4,068,673 | 1/1978 | Bernardi | 135/90 X |
| 4,125,240 | 11/1978 | Heard | 248/218.4 |

FOREIGN PATENT DOCUMENTS

| | | | |
|---|---|---|---|
| 13707 | of 1894 | United Kingdom | 135/90 |

*Primary Examiner*—Robert A. Hafer
*Assistant Examiner*—Arnold W. Kramer
*Attorney, Agent, or Firm*—Cushman, Darby & Cushman

[57] ABSTRACT

The disclosure herein describes a bracket for securing a tent structure to a supporting structure such as a ladder, a pole, or any other installation where a worker or user must be sheltered. The bracket comprises a horizontal frame which displays at each opposite end thereof, a rotatable arm provided with locking elements for fixing it at an angular position relative to the horizontal frame. The remote free end of each arm is adapted to fixedly receive a strut element of the tent structure.

15 Claims, 12 Drawing Figures

FIG. 2
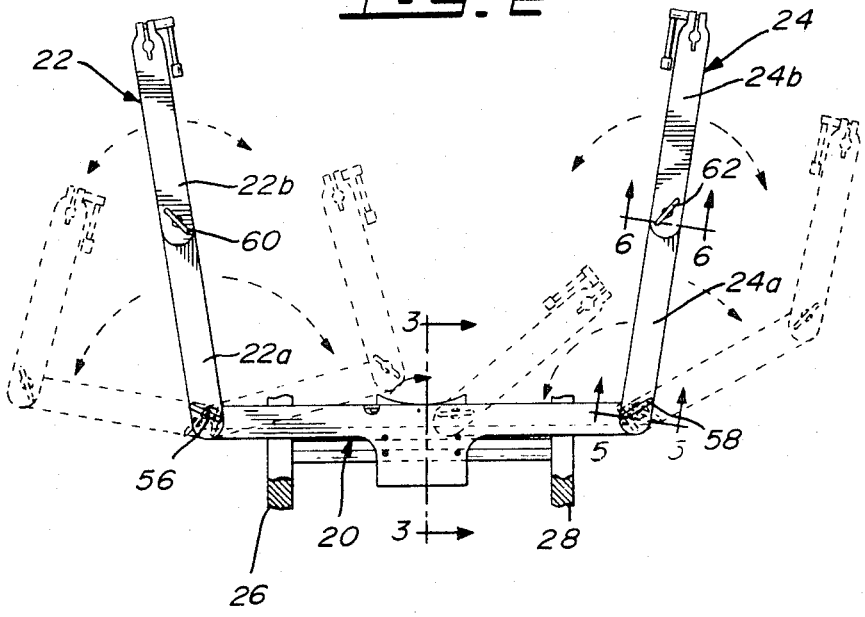
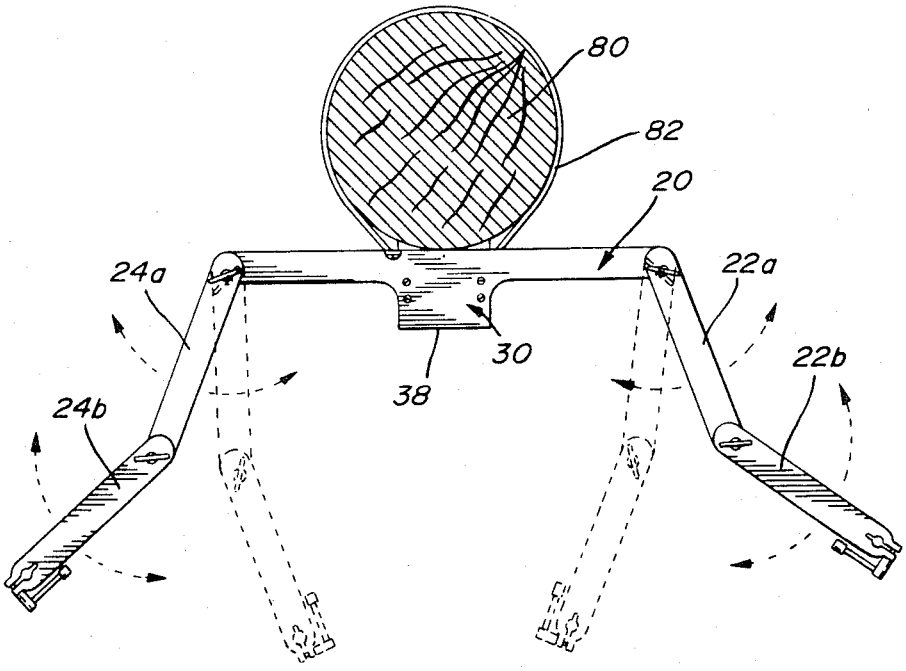
FIG. 8

FIG. 9
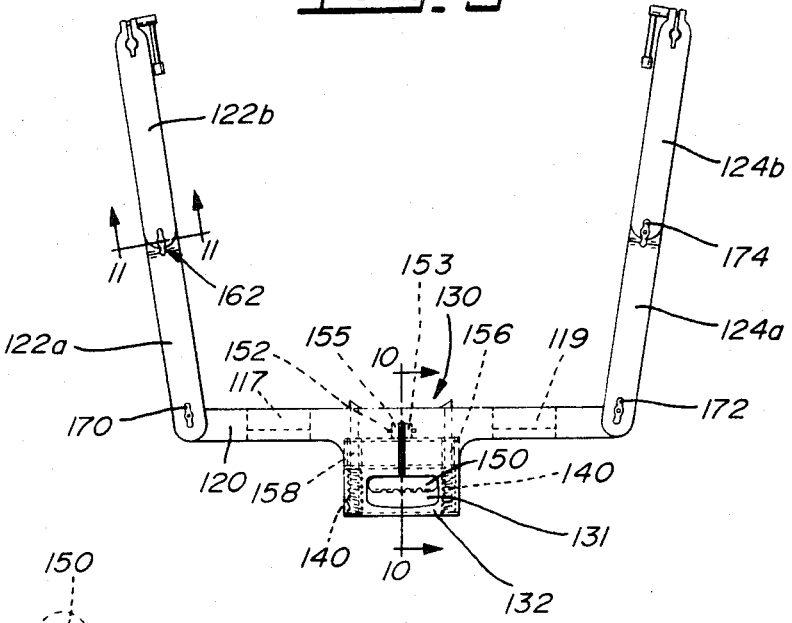
FIG. 10
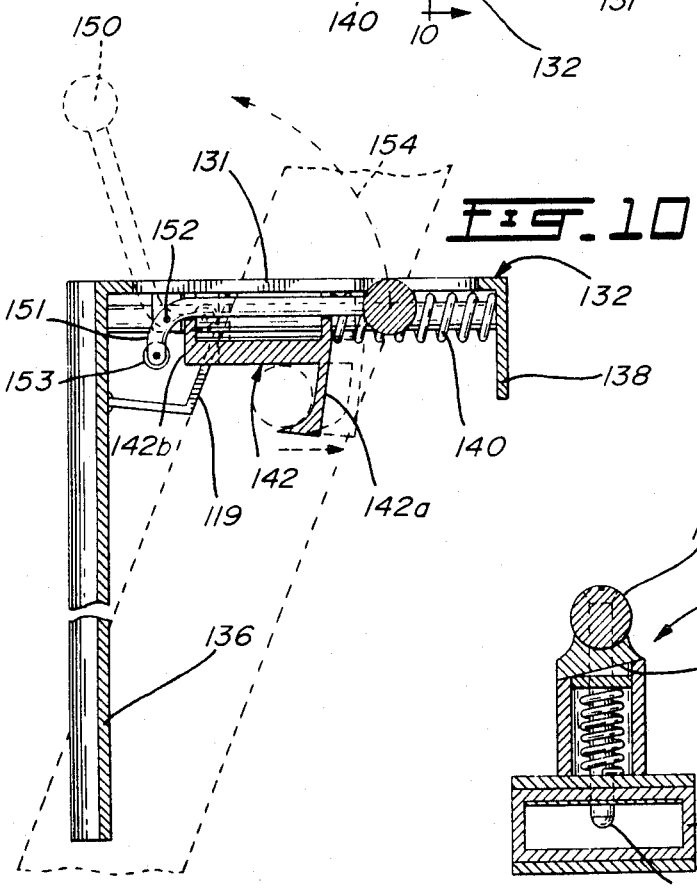
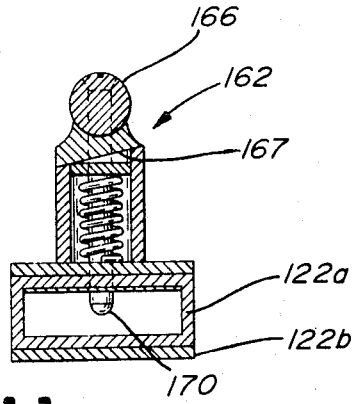
FIG. 11

TENT BRACKET

FIELD OF THE INVENTION

The present invention relates to a bracket for securing a tent structure to a supporting structure.

BACKGROUND OF THE INVENTION

The type of tent structures to which the present invention relates is that which is collapsible and provides a temporary shelter from the elements for workers carrying out certain tasks under its protection. Such tents are used, for example, by public utilities service personel when working at ground level or in underground installations where the entrance through a manhole must be sheltered. One example of such collapsible tent and frame may be found described in U.S. Pat. No. 3,810,482 issued May 14, 1974 to Beavers.

It has been found that such tent structures are also extremely useful on utilities pole or ladder. However, as of now, no support bracket has been devised to securely mount these tent structures on above ground supporting structures.

OBJECTS AND STATEMENT OF THE INVENTION

It is therefore an object of the present invention to provide a bracket which enables a tent structure to be installed at various locations to provide temporary shelter from the elements to users or workers carrying out certain tasks under its protection.

It is also an object of the present invention to provide a tent bracket suitable for various mountings (ladder, pole, etc.)

It is a further object of the present invention to provide a tent bracket which is compact and which may be folded and carried easily when not in use.

The present invention therefore relates to a tent bracket for securing a tent structure to a supporting structure, comprising:

a horizontal frame having a central portion and opposite extremities;

means provided at the central portion for securing the horizontal frame to the supporting structure;

a pair of arms each having one end rotatably mounted to a respective extremity of the horizontal frame and the other end adapted to detachably receive the tent structure, each arm being angularly adjustable relative to the horizontal frame; and means for fixing the arms in angular position relative to the horizontal frame.

In one preferred form of the invention, each arm is formed of a pair of sections wherein one of the sections is rotatably mounted at one end thereof to the horizontal frame while the other section has its remote free end adapted to be connected to the tent structure. Both sections have their remaining ends interconnected in a rotatable manner with means for fixing them in a predetermined angular relation to one another.

The central portion of the tent bracket is shaped either to fit onto the rung of a ladder or directly to a pole. However, it should be noted that the bracket of the present invention may have many other uses; for example it may be mounted to the support structure which is usually found adjacent a manhole. Furthermore, the bracket of the present invention should not be limited to its spplication with tent shelters for utilities service personnel. For example, the tent bracket could be mounted to the side frame of a boat for sheltering people, such as fishers, from the elements.

Another embodiment of the present invention is the arrangement of the arms in a plane which is offset with respect to the plane of the horizontal frame so that the arms can be folded over the frame and may be compactingly stored for easy transportation.

Other objects and further scope of applicability of the present invention will become apparent from the detailed description given hereinafter. It should be understood, however that this detailed description, while indicating preferred embodiments of the invention is given by way of illustration only since various changes and modifications within the spirit and scope of the invention will become apparent to those skilled in the art.

IN THE DRAWINGS

FIG. 2 is a top plan view showing the bracket mounted on the ladder;

Figure 1:
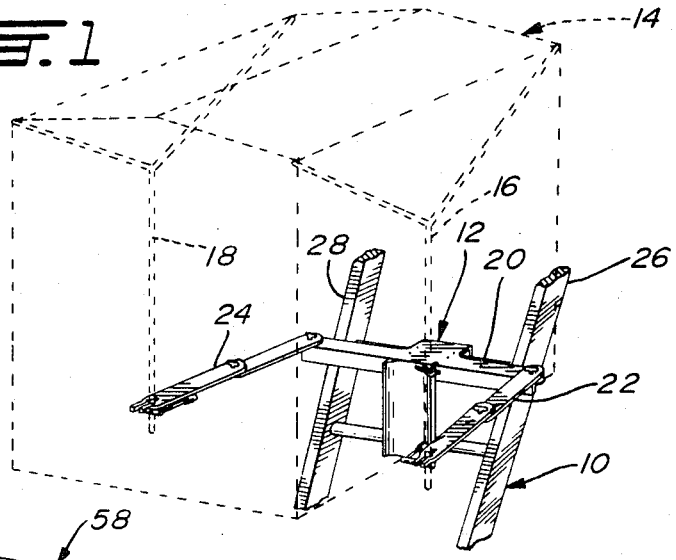
FIG. 1 is a perspective view showing a tent bracket made in accordance with the present invention, being mounted on a ladder and supporting a tent structure shown in dotted lines.
Figure 5:
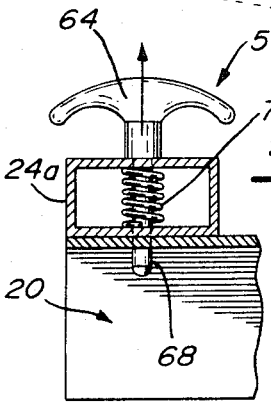
Figure 3:
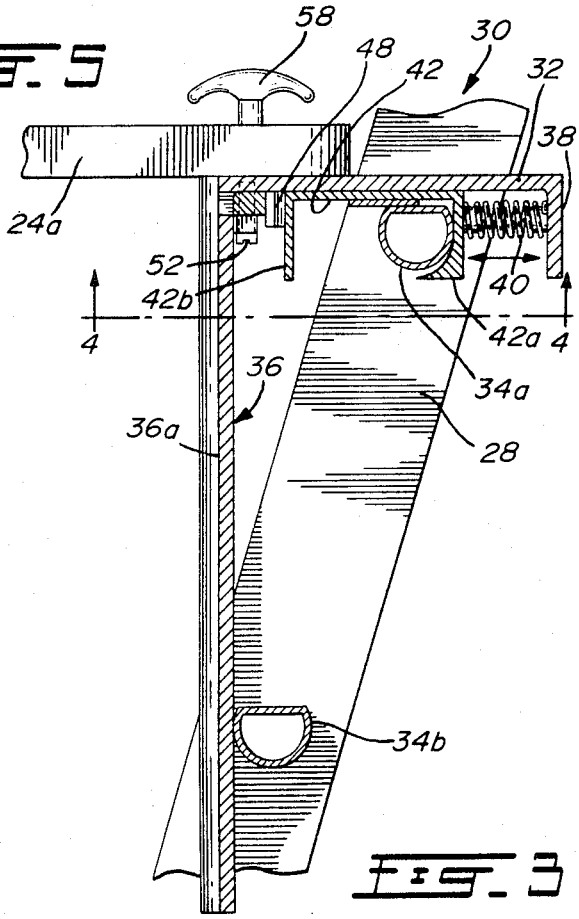
FIG. 3 is a cross-sectional view taken along lines 3—3 of FIG. 2, this figure is seen on the same sheet as FIG. 1.
Figure 6:
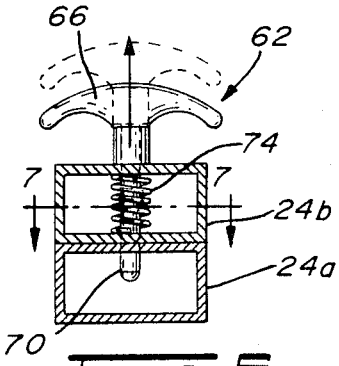
Figure 7:
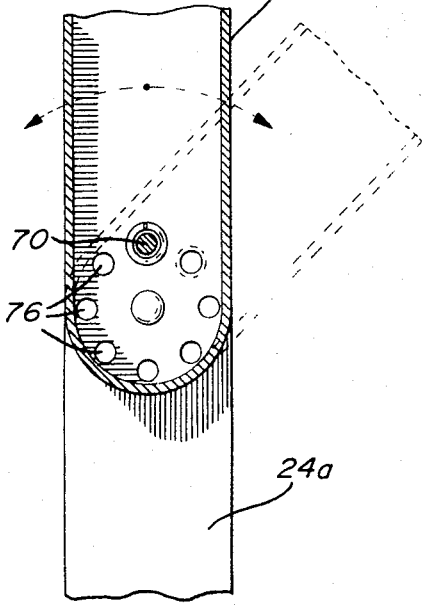
Figure 3A:
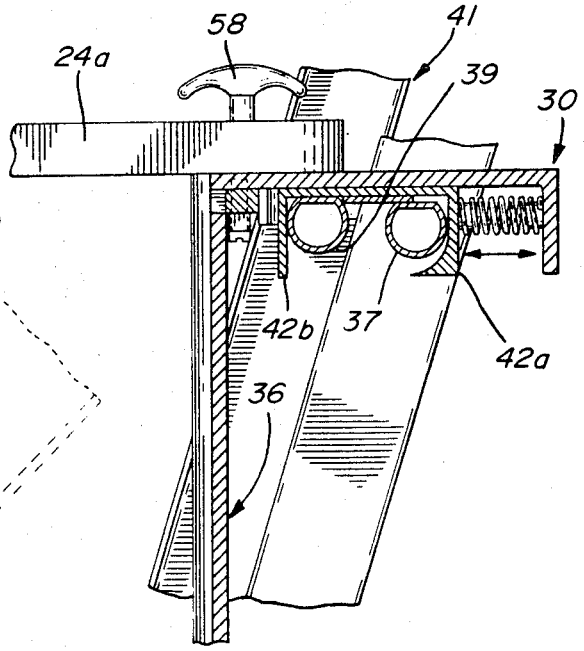
Figure 4:
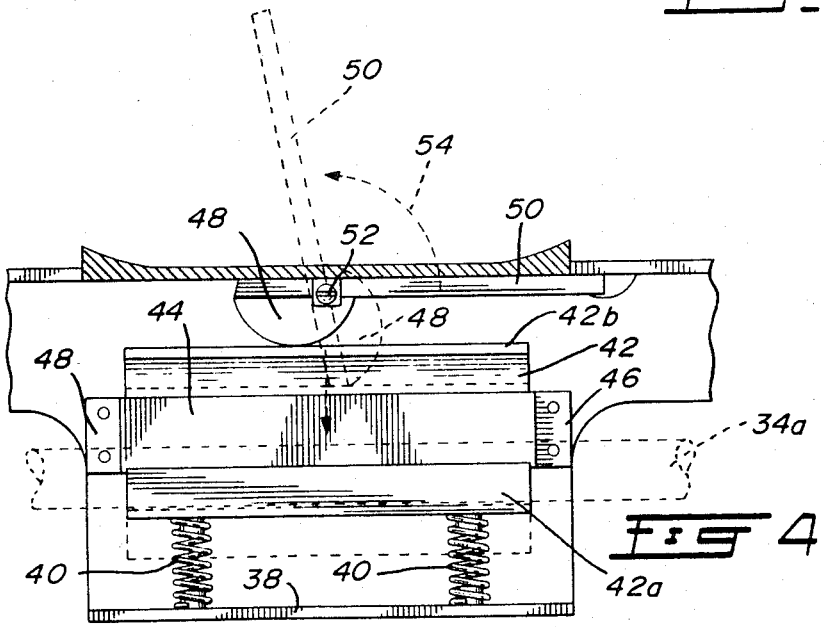

FIG. 3*a* is a view similar to FIG. 3 showing the tent bracket mounted on two rungs of a double ladder;

FIG. 4 is a bottom view as seen from lines 4—4 of FIG. 3;

FIG. 5 is a cross-sectional view as seen from lines 5—5 of FIG. 2, this figure being on the sheet showing FIG. 1;

FIG. 6 is a cross-sectional view taken along lines 6—6 of FIG. 2, this figure being seen on the sheet illustrating FIG. 1;

FIG. 7 is a cross-sectional view taken along lines 7—7 of FIG. 6:

FIG. 8 is a top plan view showing the tent bracket of the present invention being mounted to a pole, the figure being illustrated on the sheet showing FIG. 2;

FIG. 9 is a top plan view of another embodiment of the present invention;

FIG. 10 is a cross-sectional view taken along line 10—10 of FIG. 9; and FIG. 11 is a cross-sectional view taken along lines 11—11 of FIG. 9.

DESCRIPTION OF PREFERRED EMBODIMENTS

Referring to FIG. 1, there is shown a portion of a ladder 10 on which is mounted the tent bracket of the present invention generally designated 12. This bracket supports a tent structure 14 which is formed of a frame and a skin. Only a pair of Y-shaped struts 16 and 18 of the tent frame have been illustrated in order to better understand the present invention.

Referring additionally to FIG. 2, the tent bracket 12 of the present invention comprises a horizontal frame 20 and a pair of arms 22 and 24 mounted at each opposite end thereof. The horizontal frame 20 extends across the two vertical uprights 26 and 28 of the ladder with the two opposite ends thereof extending beyond the uprights and displaying a pair of arms 22 and 24 which are adapted to receive the lower part of the struts 16 and 18 of the tent frame. Each arm 22, 24 is formed of two articulated sections 22*a* and 22*b*, 24*a* and 24*b*, respectively.

Referring more particularly to FIG. 3, the horizontal frame 20 includes a central portion 30 which is formed of a horizontal plate 32 which extends rearwardly between the ladder uprights and is adapted to engage one rung 34*a* of the ladder and of a vertical plate 36 which is adapted to engage the next lower rung 34*b* of the ladder. The horizontal plate 32 has a downward rear wall 38, the innerface of which abuts a pair of springs 40 which have their opposite ends acting against an inverted U-shaped rung engaging member 42. The spring forces its end wall 42*a* against the rung 34*a*. In FIG. 3*a*, member 42 is shown engaging two adjacent rungs 37 and 39 of a double ladder generally denoted 41.

Referring to FIG. 4, the horizontal portion of member 42 slides into an elongated bracket 44 having its opposite ends 46 and 48 fixed to the undersurface of the horizontal plate 32. The opposite end 42*b* of member 42 bears against a semi-circular portion 48 of a lever 50. It will be seen that pivoting the lever 50 about a pin 52 in the direction of arrow 54 will cause portion 48 to move member 42 against the force exerted by the pair of springs 40, to thereby free wall 42*a* from the rung 34*a*.

FIG. 2 illustrates various positions of the arm sections 22*a*, 22*b*, 24*a*, 24*b*. Hence, arm sections 22*a* and 24*a* may adopt various angular positions with respect to the horizontal frame 20 while arm sections 22*b*, 24*b* may adopt various angular positions with respect to the arm sections 22*a* and 24*a*, and, consequently, to the horizontal frame 20. Means are provided at 56, 58, 60 and 62 to fix the various arm sections into a predetermined angular position with respect to frame 20 as well as to one another. Referring more particularly to FIGS. 5 and 6, these fixing means are illustrated as consisting of a handle 64, 66, respectively, which is manually operated vertically to extend a vertical locking pin 68 and 70 under the action of a spring 72, 74 in and out of circumferentially spaced holes 76 (see FIG. 7 for handle 66).

In the embodiment illustrated in FIG. 7, the arm sections 24*a* and 24*b* are shown disposed in separate horizontal planes. This allows for possible rotation of 360° of arms 22*b*, 24*b* relative to arms 22*a*, 24*a*. As both arm sections extend in planes above that of the horizontal plate 32, they may be folded over this plate to form a compact instrument for transport and storing.

The arm sections, together, are capable of rotating 360° with respect to frame 20 so that the tent bracket of the present invention can be mounted to various support structures such as the public utilities pole 80, shown in FIG. 8. In this embodiment, the arm sections 22 and 24 are pivoted towards the plate side of the central portion 30. The vertical plate 36 has a curved outer surface 36*a* to abut the pole surface and the bracket is attached to the pole by means of a strap 82 or the like.

Referring to FIGS. 9, 10 and 11, another tent bracket made in accordance with the present invention is shown. The horizontal frame 132 of the central portion 130 has a T-shaped opening 131 in which rests a handle 150. One curved extremity 151 of the handle is equipped with a pair of rollers 153 and 155 which contact the rear wall 142*b* of the rung engaging member 142 when the handle is pivoted in the direction of arrow 154 about pin 152. Also, in this embodiment, member 142 is mounted to slide on a pair of rods 156 and 158 fixed to plates 136 and 138 of the central frame 132. A pair of springs 140 are coaxially mounted on rods 156 and 158 and abut the inner wall of frame 138 and the upper portion of wall 142*a*. By abutting wall 142*b*, rollers 153 and 155 forces member rearwardly against the springs 140 to free a rung (not shown) from the inner engaging face of wall 142*a*.

To reinforce the horizontal frame 120, a pair of braces 117 and 119 are soldered thereto on opposite sides of the central portion 130.

In this embodiment, the arm sections 122*a*, 122*b*, 124*a* and 124*b* extend in the same horizontal plane which is offset vertically, however, relative to the horizontal frame 120. As illustrated in FIG. 11, the end of arm section 122*a* is arranged to be received between the upper and lower plates of arm section 122*b*. The fixing means 162 of this embodiment are similar to those shown in FIG. 6 with the exception that the handle 166 has an inclined bottom wall 167 which maintains the locking pin 170 in the raised position after a slight rotation of the handle. Similarly constructed handles are provided at 170, 172, 174.

A detailed description of the other elements of the embodiment illustrated in FIGS. 9, 10 and 11 is not deemed necessary since their construction and operation are similar to that given for the embodiment illustrated in FIGS. 1–8.

Although the invention has been described with respect to some forms of the invention, it will be understood that it may be refined and modified in various ways. Furthermore, the use of the tent bracket of the present invention is not to be limited to that of a working instrument for the public utilities personel. Indeed, one can envisage that the tent bracket could be mounted for example to the side rim of a motor or row boat. It is therefore wished to have it understood that the present invention should not be limited in interpretation except by the terms of the following claims.

The embodiments of the invention in which an exclusive property or privilege is claimed are defined as follows:

1. A bracket for securing the struts of a tent structure to a substantially vertical supporting structure, comprising:

a horizontal frame having a central portion and opposite extremities;

means provided at the central portion for securing said horizontal frame to said supporting structure;

a pair of arms each having one end rotatably mounted to a respective opposite extremity of said horizontal frame and the other end adapted to detachably clamp a strut of said tent, each said arm being angularly adjustable in a horizontal plane relative to said horizontal frame; and means for fixing said arms in angular position relative to said horizontal frame.

2. A bracket as defined in claim 1, wherein each said arm consists of a pair of sections, a first of said sections being rotatably mounted at one end thereof to said horizontal frame while the other of said sections has its free end adapted to be connected to a strut of said tent; said sections having their remaining ends interconnected in a rotatable manner whereby said sections may bear an angular relation to one another and to said horizontal frame.

3. A bracket as defined in claim 2, wherein said arm sections extend in a same horizontal plane which is offset relative to the plane of said horizontal frame.

4. A bracket as defined in claim 2, further comprising means for fixing said sections in said angular relation to one another.

5. A bracket as defined in claim 4, wherein each said section fixing means consists of a spring-biased locking pin mounted to one of said interconnected sections and engaging one of a series of circumferentially spaced holes in the other of said interconnected sections.

6. A bracket as defined in claim 5, wherein said section fixing means include a handle associated with said locking pin; surface means on said handle for maintaining said locking pin in a non-locking position when said handle is rotated.

7. A bracket as defined in claim 1, wherein each said arm fixing means consists of a spring-biased locking pin mounted to said arm and engaging one of a series of circumferentially spaced holes in said horizontal frame.

8. A bracket as defined in claim 7, wherein said arm fixing means include a handle associated with said locking pin; surface means on said handle for maintaining said locking pin in a non-locking position when said handle is rotated.

9. A bracket as defined in claim 1, wherein said supporting structure is a pole or the like; said securing means at said central portion of said horizontal frame comprising a vertical plate adapted to contact said pole and to receive a belt, strap or the like to secure said plate to said pole or the like.

10. A bracket as defined in claim 9, wherein said plate has a curved surface for increased contact with said pole or the like.

11. A bracket as defined in claim 1, wherein said supporting structure element is a ladder, said securing means at the central portion of said frame comprising a horizontal plate and a vertical plate; spring-biased engaging means mounted underneath said horizontal plate for engaging at least one rung of said ladder with said vertical plate abutting a lower rung of said ladder, said engaging means being horizontally displaceable underneath said horizontal plate.

12. A bracket as defined in claim 11, comprising means accessible at the front of said central portion for displacing said spring-biased engaging means horizontally for disengaging said ladder rung and removing said bracket from said supporting element.

13. A bracket as defined in claim 11, comprising pivotally mounted lever means accessible through an opening in said horizontal plate; roller means on said lever means for contacting spring-biased engaging means and freeing said ladder rung and removing said bracket from said supporting element.

14. A bracket as defined in claim 1, wherein said arms extend in a horizontal plane offset relative to the plane of said horizontal frame whereby said arms may be rotated and folded in an overlapping position over said horizontal frame.

15. A bracket as defined in claim 14, wherein said arms each includes a first arm section rotatably mounted at one end thereof to a second arm section; said first and second arm sections extending in separate horizontal planes.

* * * * *